United States Patent [19]

Aalders

[11] Patent Number: 4,937,492

[45] Date of Patent: Jun. 26, 1990

[54] FLAT DISPLAY DEVICE AND CATHODE UNIT

[75] Inventor: Albert F. Aalders, Eindhoven, Netherlands

[73] Assignee: U.S. Philips Corporation, New York, N.Y.

[21] Appl. No.: 276,830

[22] Filed: Nov. 28, 1988

[30] Foreign Application Priority Data

Nov. 26, 1987 [NL] Netherlands ..... 8702829

[51] Int. Cl.[5] ..... H01J 29/70

[52] U.S. Cl. ..... 313/422

[58] Field of Search ..... 313/422

[56] References Cited

U.S. PATENT DOCUMENTS 4,554,564 11/1985 Van Gorkam et al. ..... 313/422 X
4,621,215 11/1986 Tanaka ..... 313/422
4,845,402 7/1989 Smith ..... 313/422

FOREIGN PATENT DOCUMENTS 98443 6/1984 Japan ..... 313/422

*Primary Examiner*—Palmer C. DeMeo
*Attorney, Agent, or Firm*—John C. Fox

[57] ABSTRACT

A cathode unit, comprising one or more cathodes deflection means and a row of electron multipliers, is arranged on an end wall of a flat display device. If necessary, the cathode unit may be manufactured as a separate unit.

10 Claims, 1 Drawing Sheet

FLAT DISPLAY DEVICE AND CATHODE UNIT

BACKGROUND OF THE INVENTION

The invention relates to a flat display device comprising a substantially evacuated envelope having mainly flat, substantially parallel front and rear walls, a layer of luminescent material along the inner surface of the front wall and at least one cathode unit having at least one cathode for generating at least one electron beam which moves substantially in a plane parallel to the front and rear walls via electron guns means, and which can be selectively deflected in the direction of the layer of luminescent material via deflection means in a vertical deflection unit, so that each beam scans at least a part of the layer of luminescent material.

The invention also relates to a cathode unit for use in a display device of the type described.

A display device of this type holds out the possibility of realizing thin flat television screens. Research is being done on constructions of such types to enable reduction in the thickness of the glass walls, while maintaining the strength necessary for the high vacuum. Other points of research aim at obtaining a uniform brightness throughout the picture surface, independent of the driven pixel, and the possibility of integration with control electronics.

A display device of the type described in the opening paragraph is known from Netherlands Patent Application No. 76,10521 laid open to public inspection.

In this device electron beams either from a source for one beam or from a line cathode arranged on or along the end wall of channels, respectively, are guided through the channels and subsequently they are not only deflected to the phosphor screen, but also are scanned in the transverse direction of the channel by means separate from the electron gun, to simplify the electron gun for such a device.

The dimensions of conventional cathodes are such that generated electron beams of two cathodes located at a minimum distance from each other enclose a plurality of pixel columns, thus requiring a horizontal deflection over a plurality of pixels. Moreover, the energy supplied is high. Thus, the solution proposed in the above-cited Patent Application is extremely costly on grounds of energy considerations and extra material costs (horizontal deflection electrodes in the channels).

The use of semiconductor cathodes in different display devices has already been proposed, notably in U.S. Pat. No. 4,303,930. However, such cathodes have the drawback that, although they amply meet the requirements imposed on dimensions for use in a device in accordance with NL 7610521, their efficiency rapidly deteriorates due to an ion bombardment caused by positive ions which are created notably in the high-voltage section of the device.

SUMMARY OF THE INVENTION

A display device according to the invention is characterized in that the cathode unit comprises deflection means for one or more electron beams and in that a row of electron multipliers is arranged in the beam path between the cathode and the deflection unit.

The cathode is preferably a semiconductor cathode in which the main surface of the semiconductor body is preferably substantially perpendicular to the plane in which the electron beams move.

In this case it is not absolutely necessary for the emissive surface to coincide with the main surface of the semiconductor body. For example, cathode may be in the form of one or more punctiform emitters as described in the Netherlands Patent Application NL 7905470 laid open to public inspection.

The invention is based on the recognition that the assembly of cathode, deflection means and electron multipliers functions, as it were, as an ion trap due to the deflection of the electron beam between the cathode and the electron multipliers.

This ensures a longer lifetime of the cathode. This improvement is all the more effective as the total number of required (semiconductor) cathodes in the entire display device can be reduced, for example, by increasing the number of columns driven by one cathode.

Since horizontal deflection means are associated with the cathode, the channels described in Netherlands Patent Application 7610521 laid open to public inspection can be dispensed with.

However, deviations due to the earth's magnetic field which are largely corrected in conventional tubes by means of electron-optical systems must now be avoided in a different way.

To this end, the plane within which the electron beams move parallel to the front and rear walls is substantially entirely surrounded by a magnetic shield whose outer cladding may also function as a high-voltage electrode.

There are various possibilities for the display after the deflection of the electron beam from the plane parallel to the front and rear walls.

For example, the so-called penetration principle may be chosen (for example, in the case of two colours), by which the voltage at the front wall is varied dependent on the colour to be displayed. Alternatively, the so-called index principle may be used.

However, the display device preferably comprises a shadow mask (which may be provided, if necessary, with deflection electrodes). The shadow mask may form part of the above-mentioned magnetic shield unit. For the display of a picture, two (monochrome) or six (colour) line memories are required in this case for displaying the previous picture or storing the next (sub-)picture.

A light valve may also be arranged in front of the front wall, for example, a liquid crystal device successively passing the red, green and blue sub-pictures. In this case the device should be provided with picture memories.

A cathode unit according to the invention comprises at least one cathode, deflection means for one or more electron beams and a row of electron multipliers.

BRIEF DESCRIPTION OF THE DRAWINGS

The invention will now be described in greater detail, by way of example, with reference to the accompanying drawing in which.

The drawings are diagrammatic and not to scale; corresponding components usually have the same reference numerals.

DESCRIPTION OF THE PREFERRED EMBODIMENTS

Figure 1:
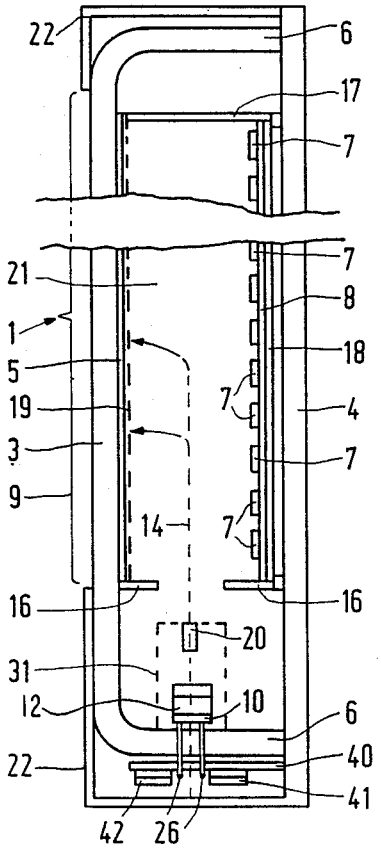
FIG. 1 is a diagrammatic cross-section of a display device according to the invention.

FIG. 1 is a diagrammatic cross-section of a display device 1 according to the invention, comprising a substantially evacuated envelope having a front wall 3 and a rear wall 4. Together with the side walls 6, the front wall 3 forms part of a glass lid or tub having an overall height of, for example, 5 cm, while the rear wall 4 in this embodiment is in the form of a thin steel wall which may have reinforcement ribs, if necessary. A layer of luminescent material, for example, a phosphor screen 5 is present on the inside of the front wall 3.

The display device 1 also comprises means for generating a plurality of electron beams 14 which move at least substantially in a plane parallel to the front wall 3 and the rear wall 4 before they are deflected in the direction of the phosphor screen 5. The electron beams move not only parallel to the front wall 3 and the rear wall 4 but also substantially perpendicular to the picture lines of the picture to be displayed, because horizontal deflection is effected in the cathode unit 31 before the electron beams reach the deflection unit which is bounded by the walls 3, 4 and the end walls 16, 17. The phosphor parts to be impinged on (in other words, the picture line to be activated) are selected via voltages at deflection electrodes 7 arranged on an insulated carrier 8 in this embodiment. The electron beams 14 are thereby deflected to the phosphor screen 5.

The electrons are generated by means of semiconductor cathodes 10, which may be controlled separately, and they are subsequently accelerated by electrodes 24, thereby forming electron beams 14, while the emissive surface 12 extends perpendicularly to the walls 3, 4 in this embodiment. The electron beams 14 are horizontally deflected by means of horizontal deflection electrodes 15 directly after the formation of the beam.

According to the invention a row of electron multipliers 20 is arranged between the horizontal deflection electrodes 15 and the high-voltage section 21 to intensify the electron beam 14. Subsequently, the electron beam 14 intensified by the operation of the electron multiplier, moves substantially parallel to the front wall 3 and the rear wall 4 and also perpendicularly to the end walls 16, 17 until vertical deflection towards the phosphor screen 5 takes place.

The electron multipliers 20 have a dual function. On the one hand electron multiplication is effected so that a picture of greater intensity can be obtained. On the other hand, possible positive ions, which are generated by the electrons in the high-voltage section 21 and accelerated by the dominant field in the direction of the cathode unit, are captured by the electron multipliers 20 so that they cannot damage the cathode 10.

Figure 2:
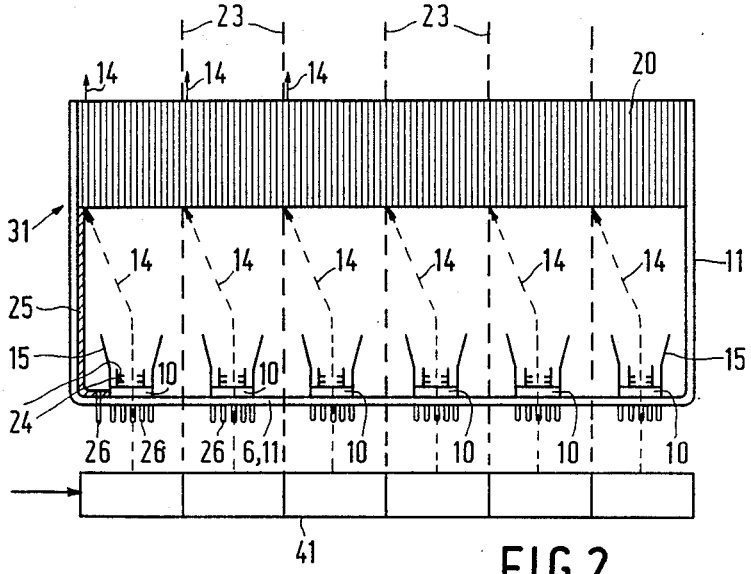
FIG. 2 is a cross-section along a part of the device of FIG. 1, perpendicular to the cross-section shown in FIG. 1.

In the device as shown in FIGS. 1 and 2, the deviation which the beams 14 may acquire with the aid of the horizontal deflection electrodes 15 is chosen to be such that each cathode covers, for example, n columns. The cathode unit 31 is thus seemingly split up into a plurality of sub-units denoted by means of broken lines 23. The deflection electrodes 15 and the cathodes 10 are now controlled by means of periodic deflection voltages at the deflection electrodes 15, which are in turn controlled by information from a line register 41 in such a manner that the information associated with the relevant line is presented to the columns 1, n+1, 2n+1 . . . at instant $t_1$; to the columns i, n+i, 2n+i at instant $t_i$ ($1<i<n$), and to the columns n, 2n, 3n, . . . ., 3n . . . . . at instant $t_n$. After the information of the next line to be written is written in the line register 41 and the control of the line electrodes 7 (for example, via a switching element, not shown) has been adapted, this procedure is repeated.

The cathodes and other elements, including acceleration electrodes 24, can be controlled via electrical connections to lead-throughs 26. The voltage for the electron multiplier is ensured, for example, via contact conductors 25.

The electron beams 14 from the cathodes 10, deflected by the electrodes 15 and intensified in the electron multipliers 20, are subsequently accelerated parallel to the front and rear walls before they reach the actual display section 9. The electrons may exhibit deviations from their straight path under the influence of the earth's magnetic field, while a lateral correction is not possible. For this reason the plane within which the electrons are accelerated and moved parallel to the front and rear walls is substantially entirely surrounded by a magnetic shield, formed in this embodiment from a cagelike construction comprising, for example, the carrier 8 for the electrodes 7, whose rear side is to this end provided with a metal layer or metal pattern 18, electrically conducting apertured wall 16 (also serving as the high-voltage grid for the electron beams), end wall 17, and shadow mask 19, with layer 18, walls 16 and 17, and mask 19 being connected together to form a magnetically closed assembly. Other, more open constructions are alternatively possible. Generally known methods of demagnetizing can be used, if necessary. The electrodes 7 can be controlled via control circuits (not shown) which are also arranged, for example, on the carrier 8 and are contacted by means of metal tracks (not shown) projecting outside the side wall 6.

The envelope is contained in a protective cabinet 22, leaving free the visible part of the picture and accommodating operating elements as well as control circuit elements 41, 42 arranged on, for example, a printed circuit board 40.

As already described in the opening paragraph, there are various other possibilities for the display of the picture after the electron beam 14 has been deflected towards the phosphor screen 5. For example, in the case of colour display the penetration principle may be used, notably when using display tubes with at most two colours, or the so-called index principle may be used.

In the device shown the phosphor screen 5 is split up, for example, into horizontal tracks of luminescent material. The information for each of the three colours is presented during $\frac{1}{3}$ of the line period, whereafter the voltages at the deflection electrodes are slightly changed and the information for the adjacent colour track is presented during $\frac{1}{3}$ of the line period, etc. Since the (colour) information is simultaneously read in the case of TV display and is then presented serially in accordance with the incoming signal, the colour information is temporarily stored in line memories. Each colour to be displayed requires two line memories, namely one for the line which is being read and a second in which the next line is stored.

Another possibility is the use of so-called light valves in which a monochrome tube is controlled each time during $\frac{1}{3}$ of the picture period with the red, the green and the blue picture signal, respectively, while light valves, for example, LCDs with red, green or blue colour filters arranged in front of the tube are synchronously switched on. In this case the presence of picture memories is required.

In the device of FIG. 1 the cathodes 10 are secured to a side wall 6 of the envelope 2 of the vacuum space. The cathode unit 31, with cathodes 10, acceleration electrodes 24, deflection electrodes 15 and electron multipliers 20 may of course also be manufactured separately in a glass envelope 11, as shown in FIGS. 2 and 3, which is secured to the end of the vacuum space at a later stage of manufacture.

Figure 3:
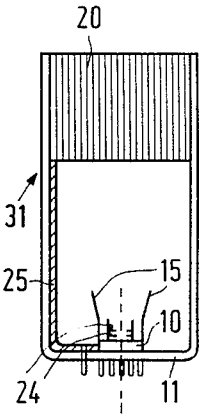
FIG. 3 is a cross-section of a separate cathode unit.

The sub-units denoted by the broken lines 23 may also be manufactured separately as shown in FIG. 3, and may subsequently be secured next to one another. This has the advantage that the separate units can be individually tested and replaced, if necessary. The number of electron multipliers in the device of FIG. 3 may of course also be extended in such a way that all columns of the picture can be covered by means of one cathode 10. If necessary, a thermal cathode instead of a semiconductor cathode may be used.

What is claimed is:

1. A flat display device comprising a substantially evacuated envelope having mainly flat, substantially parallel front and rear walls, a layer of luminescent material along the inner surface of the front wall and means for generating at least one electron beam which moves substantially in a plane parallel to the front and rear walls and which can be selectively deflected in the direction of the layer of luminescent material via vertical deflection means, so that each beam scans at least a part of the layer of luminescent material, said means for generating the at least one beam comprising at least one cathode unit having at least one cathode which can be controlled separately, characterized in that the cathode unit comprises horizontal deflection means and in that a row of electron multipliers is arranged in the beam path between the cathode and the vertical deflection means.

2. A display device as claimed in claim 1, in which the cathode unit comprises a semiconductor cathode including a semiconductor body having a main surface.

3. A display device as claimed in claim 2, in which the main surface of the semiconductor body extends substantially perpendicular to the plane in which the electron beams move.

4. A display device as claimed in claim 1, in which the rear wall is comprised of a soft magnetic material.

5. A display device as claimed in claim 4, in which the material is steel.

6. A display device as claimed in claim 1, in which the plane within which the electron beams move parallel to the front and rear walls is substantially entirely surrounded by a magnetic shield.

7. A display device as claimed in claim 1 in which a shadow mask is positioned in spaced relationship to the layer of luminescent material.

8. A display device as claimed in claim 1, in which the cathode unit comprises a row of electron multipliers.

9. A display device as claimed in claim 8, in which the at least one cathode is a semiconductor cathode including a semiconductor body having a main surface.

10. A display device as claimed in claim 9, in which the main surface of the semiconductor body extends substantially parallel to the row of electron multipliers.

* * * * *